US005085606A

United States Patent [19]

Kaplan et al.

[11] Patent Number: 5,085,606

[45] Date of Patent: Feb. 4, 1992

[54] METHOD OF MANUFACTURE FOR POST-MASK DEFLECTION TYPE TENSION MASK COLOR CATHODE RAY TUBE

[75] Inventors: Sam Kaplan, Chicago; Robert Adler, Northfield, both of Ill.

[73] Assignee: Zenith Electronics Corporation, Glenview, Ill.

[21] Appl. No.: 635,083

[22] Filed: Dec. 28, 1990

Related U.S. Application Data

[62] Division of Ser. No. 336,478, Apr. 12, 1989.

[51] Int. Cl.[5] ..... H01J 29/07; H01J 9/00

[52] U.S. Cl. ..... 445/30; 445/33

[58] Field of Search ..... 445/30, 33, 34; 313/407, 408

[56] References Cited

U.S. PATENT DOCUMENTS

| | | | |
|---|---|---|---|
| 2,728,024 | 12/1955 | Ramberg | 313/408 |
| 2,791,710 | 5/1957 | Dressler | 445/34 |
| 3,623,197 | 11/1971 | Jones | 228/159 |
| 3,894,321 | 7/1975 | Moore | 445/30 |
| 4,532,453 | 7/1985 | Kato | 445/30 |
| 4,666,415 | 5/1987 | Morimoto et al. | 445/33 |
| 4,695,761 | 9/1987 | Fendley | 313/407 |
| 4,716,334 | 12/1987 | Fendley et al. | 313/407 |
| 4,745,328 | 5/1988 | Strauss | 313/408 |
| 4,779,023 | 10/1988 | Strauss | 313/407 |

*Primary Examiner*—Richard K. Seidel
*Assistant Examiner*—Jeffrey J. Knapp

[57] ABSTRACT

A post-mask-deflection color cathode ray tube is disclosed that has a strip-type tension foil shadow mask in the form of two intercalated combs providing mutually insulated first and second arrays of strips. Each of the arrays is adapted to receive a different electrical potential effective to cause electron beams passing therethrough to be deflected by the electrical fields created between the strips. A method of manufacturing is also disclosed.

15 Claims, 3 Drawing Sheets

FIG. 1
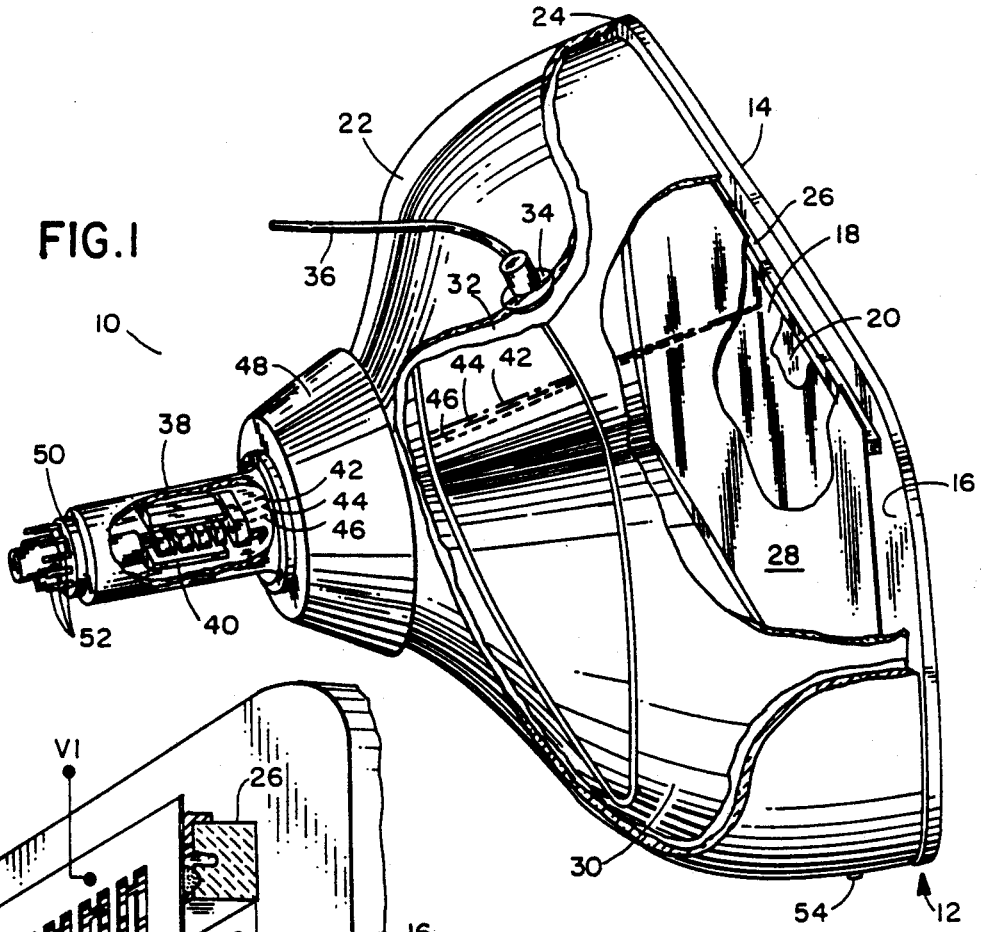
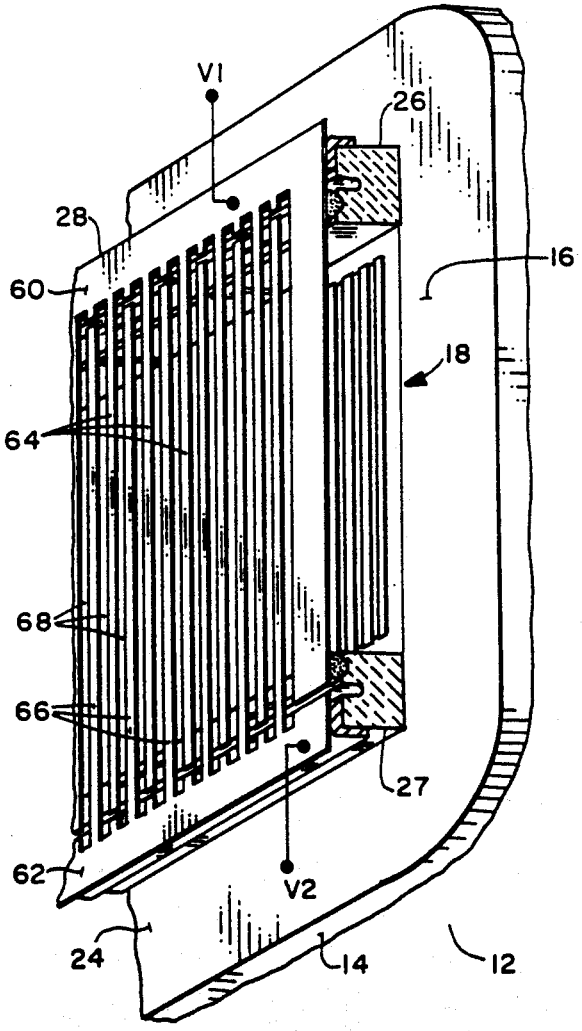
FIG. 2

FIG. 4a
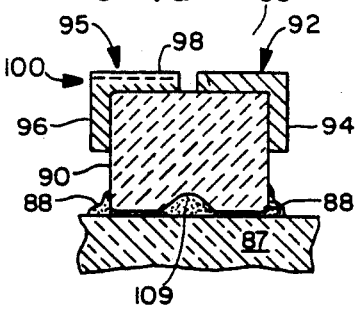
FIG. 4b
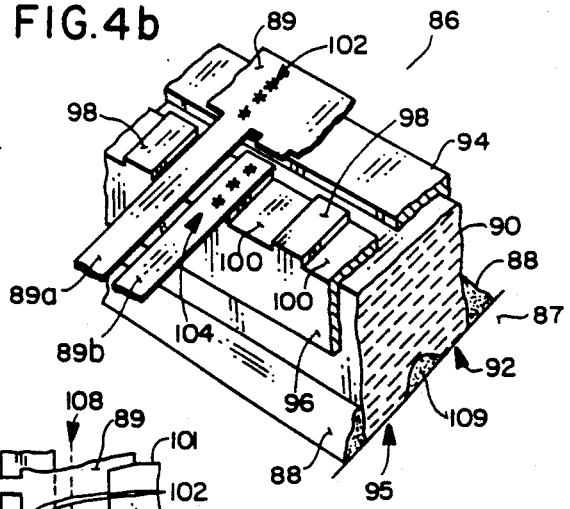
FIG. 4c
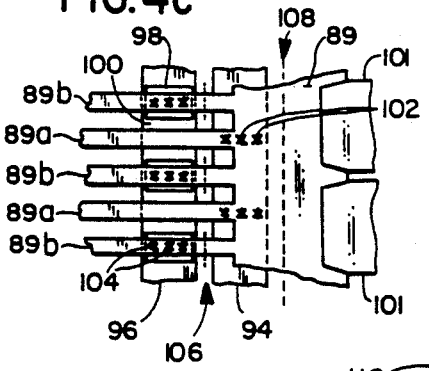
FIG. 5a
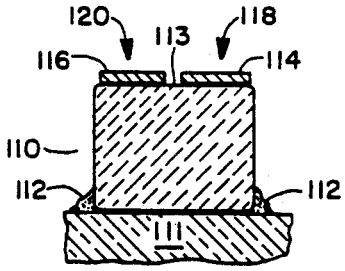
FIG. 5b
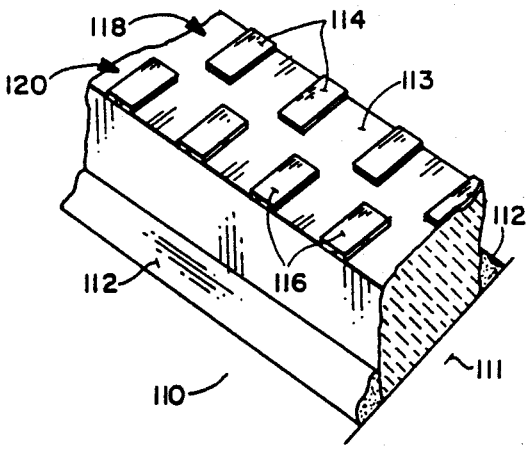
FIG. 5c
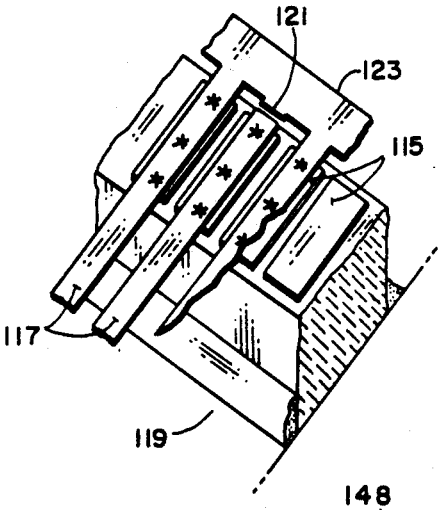
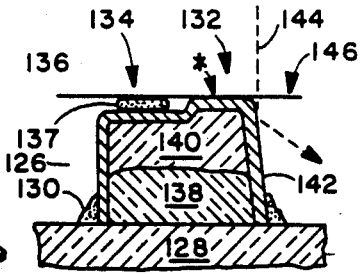
FIG. 6
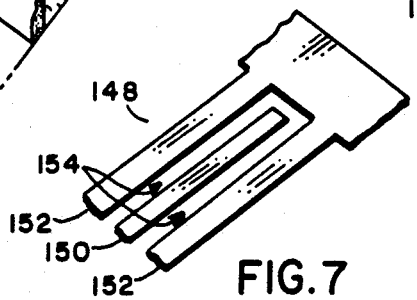
FIG. 7

METHOD OF MANUFACTURE FOR POST-MASK DEFLECTION TYPE TENSION MASK COLOR CATHODE RAY TUBE

This application is a division of Ser. No. 07/336,478 filed Apr. 12, 1989, now allowed, commonly owned herewith.

CROSS-REFERENCE TO RELATED APPLICATIONS

The application is related to but in no way dependent upon copending applications Ser. No. 058,059 filed June 4, 1987; Ser. No. 223,475 filed July 22, 1988; Ser. No. 269,822 filed Nov. 10, 1988; Ser. No. 292,197 filed Dec. 30, 1988; Ser. No. 026,926 filed Mar. 17, 1987; Ser. No. 178,175 filed Apr. 6, 1988; Ser. No. 192,412 filed June 29, 1988; Ser. No. 234,450 filed July 22, 1988; Ser. No. 269,822 filed Nov. 10, 1988; and Ser. No. 292,197 filed Dec. 30, 1988, Ser. No. 458,129 filed Dec. 28, 1989, and Ser. No. 519,090 filed May 4, 1990, all of common ownership herewith.

BACKGROUND OF THE INVENTION

This invention is generally related to cathode ray tubes for use in color television receivers. It is specifically directed to an improvement in a color cathode ray tube of the "post-mask-deflection" type described in U.S. Pat. No. 3,452,242 to Miyaoka. FIGS. 4 and 5 of that patent illustrate a color selection electrode consisting of parallel wires designated alternately 1*a* and 1*b*. All wires 1*a* form one group and all wires 1*b* form a second group. Following Miyaoka's description, a 280 volt difference in DC potential is maintained between the two groups, both of which are operated at approximately 20 kV with respect to the cathodes. As a consequence of this 280 volt difference, electron beams passing through the slots between the wires are deflected so that they overlap on the screen behind each wire of the more positively charged group, 1*b* in Miyaoka FIGS. 4 and 5.

The post-mask-deflection type of mask is an arrangement that makes it possible to use relatively wide slots between the wires, so that the percentage of electrons actually reaching the screen is 40–50%, compared to only 15–20% in a conventional color tube in which the color selection electrode is a simple shadow mask.

In spite of this advantage, that type of post-mask-deflection cathode ray tube has not found commercial use because of the need to insulate adjacent wires from each other so that the required potential difference can be maintained. This requirement made it impossible (prior to the present invention) to use a metal frame to support the shadow mask, such as that shown in U.S. Pat. No. 4,695,761 to Fendley, assigned to the assignee of the present invention.

U.S. Pat. No. 3,894,321, issued to Moore, and also assigned to the same assignee as this invention, discloses a method for processing a color cathode ray tube having a thin foil mask sealed directly to the bulb. A post-mask-deflection mask embodiment involving a high-transmission mask is shown in FIGS. 7 and 7*a* of the '321 patent, and is described in column 8, lines 14–40. Following the assembly process as described in the '321 patent, a foil mask 32 is laid over ledges 27 of the front panel 10. The excess foil which lies beyond the ledges 27 may then be cut away along dashed lines 34 and 36, thus leaving a set of tabs on each side of the panel.

To carry out the teaching of the '321 patent, the individual foil strips must be fastened under tension to ledges 27, which must provide insulation between adjacent strips. If ledges 27 are part of the front panel as contemplated by the '321 patent, insulation presents no problem, but to provide a bond strong enough to maintain the tension applied to the foil strips, solder glass (i.e., powdered low-melting-point glass) must be used. This requires tensioning the foil mask in a temporary stretching frame, placing frame and mask upon the front panel with ledges 27 solder glass-coated, passing the entire assembly through an oven where devitrification of the solder glass takes place, then cooling the assembly to room temperature, and finally cutting off the unneeded parts of the foil. Only at this point can the temporary stretching frame be removed to be used over again in connection with another panel. The devitrifying of the solder glass and cooling process typically takes several hours because the front panel must not be subjected to dangerous temperature gradients. Thus the process ties up expensive capital equipment, including the temporary stretching frame and space in the oven, for several hours.

OBJECTS OF THE INVENTION

It is an object of this invention to provide a practical post-mask-deflection color cathode ray tube.

It is another object of this invention to provide a cathode ray tube having a tension mask suitable for post-mask deflection, and which can be manufactured economically.

It is a further object of the invention to provide an improved support structure and method for mounting a post-mask-deflection tensed foil shadow mask in association with a substantially flat faceplate.

It is yet another object of this invention to provide a viable method for the manufacture of a post-mask-deflection color cathode ray tube.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings (noted as being not to scale), in the several figures of which like reference numerals identify like elements, and in which:

FIG. 1 is a side view in perspective of a color cathode ray tube and front assembly having a tension mask of the post-mask-deflection type according to the invention, with cut-away sections that indicate the location and relation of the mask to other major tube components;

FIG. 2 is a side view in perspective of the front assembly of the color cathode ray tube depicted in FIG. 1 showing further details of the post-mask-deflection foil tension mask and its supporting structure according to the invention;

FIG. 4*a* is a cross-section view in elevation of another embodiment of a post-mask-deflection mask-support structure according to the invention; FIG. 4*b* is a perspective view of the FIG. 4*a* structure; and FIG. 4*c* is a plan view of the FIG. 4*b* structure indicating the use of a laser beam for attaching a foil shadow mask, and trimming the mask, according to the invention;

FIGS. 5*a* and 5*b* are views similar to FIGS. 4*a* and 4*b* showing another embodiment of a post-mask-deflection mask-support structure according to the invention; FIG. 5*c* shows a modification according to the invention of the FIG. 5*b* configuration;

FIG. 6 is a cutaway view in elevation of a metal structure for supporting a post-mask-deflection shadow mask; and FIG. 7 is a view in perspective of a partial section of a post-mask-deflection shadow mask depicting a modification of the preferred embodiment.

DESCRIPTION OF THE PREFERRED EMBODIMENT

Figure 3A:
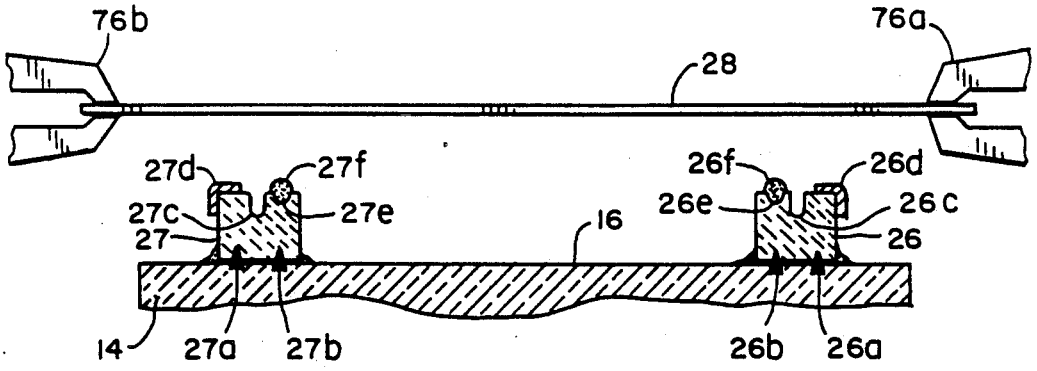
FIGS. 3*a* and 3*b* are cross-sectional views in elevation depicting a post-mask-deflection mask-support structure according to the invention, and method steps for tensing and supporting a mask.

A post-mask-deflection color cathode ray tube according to the invention is depicted in FIG. 1. The tube and its component parts are identified in FIGS. 1, 2 and 3*a*, 3*b* and 3*c*, and described in the following paragraphs in this sequence: reference number, a reference name, and a brief description of structure, interconnections, relationship, functions, operation, and/or result, as appropriate.

10: post-mask-deflection color cathode ray tube
12: faceplate assembly of cathode ray tube 10
14: faceplate made of transparent glass
16: inner surface of faceplate
18: centrally disposed phosphor screen composed of repeating patterns indicated as comprising stripes of red-light-emissive, green-light-emissive and blue-light-emissive cathodoluminescent material which emits light of the respective color when excited by respective electron beams; phosphor stripes are separated from each other by stripes of black material called the matrix or "black surround." This type of screen is also referred to as a "line screen."
20: film of aluminum coated over phosphors on the screen 18
22: tube funnel
24: peripheral sealing area of faceplate 14, adapted to mate with the peripheral sealing area of funnel 22
26, 27: shadow mask support structures according to the invention located on opposed sides of the screen 18 for receiving and securing a post-mask-deflection tensed foil shadow mask 28; the mask is mounted in tension on the support structures and secured thereto.
28: foil shadow mask indicated as comprising a slit-type mask
30: internal magnetic shield
32: conductive coating internal to funnel
34: anode button connected to conductive coating 32
36: high-voltage conductor for conducting a first potential of about 20 kV known as the "anode voltage" to the shadow mask by way of the anode button 34 and internal conductive coating 32.
38: neck of tube
40: in-line electron gun providing three discrete in-line electron beams 42, 44 and 46 for exciting the respective red-light-emissive, green-light-emissive, and blue-light-emissive phosphor deposits on screen 18.
48: yoke which provides for the traverse of beams 42, 44 and 46 across screen 18.
50: base of tube
52: metal pins for conducting operating voltages and video signals through base 50 to gun 40
54: high-voltage conductor for conducting a second, different post-mask-deflection voltage to mask 28

As indicated by FIGS. 1 and 2, a front assembly 12 for a post-mask-deflection cathode ray tube 10 includes a faceplate 14, indicated symbolically as being composed of glass, having on its inner surface 16 a centrally disposed phosphor screen 18. A foil shadow mask 28 according to the invention is mounted in tension on two shadow mask support structures 26 and 27 located on opposed sides of screen 18 and secured to the inner surface 16 of the faceplate 14.

FIG. 2 is a schematic, perspective view of the front assembly 12 of a color cathode ray tube constructed according to the invention. Electrically insulative shadow mask support structures 26 and 27, indicated symbolically as comprising a ceramic material, are shown as being attached to faceplate 14. Structures 26 and 27 provide for supporting tension shadow mask 28. Mask 28 according to the invention is in the form of intercalated periodic first and second arrays of electrically conductive metal strips aligned with the phosphor elements of screen 18, indicated by the stripes as being a line screen. Each array is adapted to receive a predetermined different electrical potential effective to cause electron beams passing through the mask to be deflected by electrical fields created between the strips. A mask according to the invention, shown schematically in FIG. 2, is depicted as comprising a first array 60 and a second array 62, each having respective metal strips 64 and 66 separated by spaces 68 extending therefrom. In the FIG. 2 embodiment, each array according to the invention is supported by the outer portion of one support structure and the inner portion of the opposed support structure in electrically insulating relationship.

Different electrical potentials V1 and V2 are depicted schematically as being applied to the two arrays 60 and 62. The difference in electrical potential applied to the two arrays is in the range of 150 to 350 volts, and typically may be about 280 volts.

Mask 28 will be seen as taking the form of mutually insulated intercalated combs comprising first and second arrays of metal strips extending from respective comb spines, the spines being insulatively secured to opposite ones of the support structures. The combs will be seen as being formed according to the invention by severance of the extremities of alternately staggered strips adjacent to the respective spines.

As indicated in greater detail in FIG. 3*a*, support structures 26 and 27 comprise, respectively, outer portions **26*a* and 27*a* and inner portions 26*b* and 27*b*, with the portions separated by respective spaces or grooves 26*c* and 27*c*. The outer portions 26*a* and 27*a* are topped with respective metallic caps 26*d* and 27*d*, indicated as being channels, while the inner portions are shown as having deposits of beads of solder glass 26*f* and 27*f*. Foil tension mask 28 is shown as stretched across the two support structures 26 and 27. As will be described later, mask 28 is to be attached to the outer portions 26*a* and 27*a* by welding to the metallic channels 26*d* and 27*d*, and to the inner portions 26*b* and 27*b* of support structures 26 and 27 by the adhesion of beads of solder glass 26*f* and 27*f*** in its devitrified state.

Returning now to FIG. 2, foil tension mask 28 is indicated as consisting of many parallel metal strips 64 and 66 of width W spaced from each other so that the center-to-center distance is S. Preferably, W equals about one-half of S, so that the width S minus W of the free spaces 68 between adjacent strips also approximates one-half S.

Alternate metal strips are indicated as being connected to two separate electrical terminals V1 and V2. Each of the two metallic channels 26d and 27d constitutes an electrical terminal. Each of the metal strips 64 and 66 is electrically connected to one of the two metal channels 26d and 27d, but disconnected according to the invention from the other metal channel by being cut along grooves 26c and 27c that lie between the outer portions 26a and 27a and the inner portions 26b and 27b of the support structure on the side where no electrical connection is desired. This method is described in detail later.

In a 25-inch television tube having a screen area of about 16 by 20 inches, the width of one color triad, i.e. a group of three adjacent phosphor stripes capable of emitting red, green and blue light, as well as the three corresponding black stripes, may be about 0.030 inch; for example, all color stripes and black stripes may each be about 0.005 inch in width.

In the mask used in this embodiment, the width of one color triad corresponds to the center-to-center spacing between two metal strips connected to the same electrical terminal, or to twice the center-to-center spacing S between adjacent metal strips connected to opposite terminals. In the example given, S=0.015 inch. Since the preferred width W of the metal strips equals one-half S, the numerical value of W in this example is 0.0075 inch. In practice, small corrections must be made to allow for the divergence of the electron trajectories between mask and screen; this correction reduces S and W from the above-calculated values by about 3 to 4 percent.

Figure 3B:
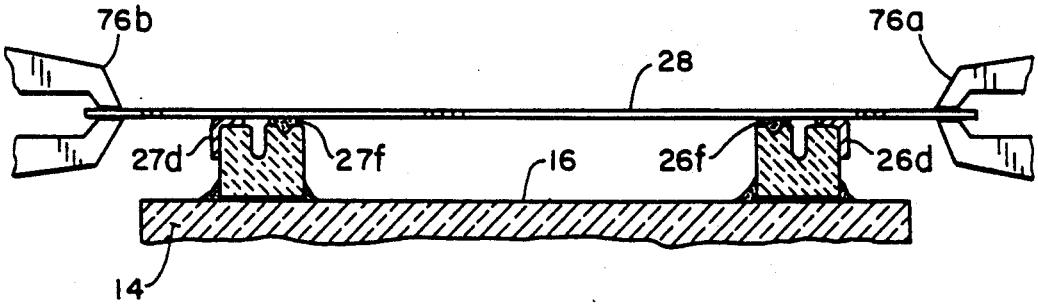

FIGS. 3a and 3b depict in side view the mask 28 stretched across the two support structures 26 and 27 to illustrate the method of assembly. As indicated in FIG. 3a, mask 28 is tensioned between two clamps 76a and 76b while being correctly positioned above support structures 26 and 27 in the manner described in detail in referent copending application Ser. No. 223,475. Briefly, and as described in the '475 application, position sensors, for example of the optical kind, provide feedback to a positioning mechanism to ensure that the metal strips are properly aligned with the pattern of phosphor stripes deposited on inner surface 16 of faceplate 14.

Initially, faceplate 14 sits below mask 28 as indicated in FIG. 3a, spaced so there is substantial clearance between support structures 26 and 27 and the mask 28. Each of the two grooves 26e and 27e is filled with respective beads 26f and 27f of devitrifying solder glass previously deposited thereon.

Support structures 26 and 27 will be seen as having specially shaped cross-sections. Outer portions 26a and 27a have a square corner to which metal channels 26d and 27d are attached; the bonding agent may be, for example, S-glass obtained from Sandia Corporation of Albuquerque, N. Mex., or it may be porcelain enamel. Bonding is achieved in a belt furnace at 1000 degrees C., and the bond then resists later processing at lower temperatures. As noted, grooves 26e and 27e located in the inner portions 26b and 27b serve to receive beads 26f and 27f of solder glass. Inner portions 26b and 27b are separated from the outer portions 26a and 27a by respective grooves 26c and 27c to keep the solder glass, which has a paste-like consistency in its unfired form, away from the surfaces of metal channels 26d and 27d. Ceramic support structures with this relatively complex cross-section are inexpensively manufactured by an extrusion process.

Electrically insulating shadow mask support structures comprised of a ceramic, and having a metal component for the attachment of a foil shadow mask, are described and claimed in a series of applications and patents of common ownership herewith, including U.S. Pat. Nos. 4,730,143; 4,737,681; 4,745,230, and referent copending applications Ser. Nos. 060,142; 178,175; 192,412; 269,822; and 292,197, all of common ownership herewith.

A suitable composition for a ceramic support structure is (in percentages) magnesia, 27; talc, 63; barium carbonate, 6; and ball clay, 4. The composition of ceramic cited is not the subject of the present application, but that of referent copending application Ser. No. 458,129 of common ownership herewith.

The solder glass may comprise No. CV-695 supplied by Owens-Illinois Television Products Division of Toledo, Ohio. Solder glasses of equivalent properties supplied by other manufacturers may be used.

The metal of channels 26d and 27d preferably comprises Alloy No. 27 manufactured by Carpenter Technology of Reading, Pa.; this material has a CTC (coefficient of thermal contraction) of approximately 105 to $109\times10^{-7}$ in/in/degree C. over the range of the temperatures required for devitrification—from ambient temperature to 435 degrees C.

With regard to FIG. 3b, when the position sensors indicate that correct alignment has been achieved, faceplate 14 is lifted until the two metal channels 26d and 27d make solid contact with mask 28. At the same time, the two beads 26f and 27f of solder glass are deformed by the tensed mask, as indicated. The end portions of the mask 28 which contact metal channels 26d and 27d are then welded to the channels, preferably by laser welding at many closely spaced points. The welding of a foil tension mask to the metal support structures, and the subsequent trimming of the mask, may follow the teachings described and claimed in referent copending application Ser. No. 058,059.

Since the mask is now firmly held under tension by metal channels 26d and 27d, clamps 76a and 76b are no longer needed. The mask is therefore cut along lines 82a and 82b, indicated by the dotted lines in FIG. 3c, preferably with the same laser used to weld the mask 28 to channels 26d and 27d. The complete assembly, including faceplate, mask support structures and mask, is then sent through a furnace having a maximum temperature of, for example, 435 degrees C. to devitrify and harden the beads of solder glass 26e and 27e. It is to be noted that this method obviates the need for sending any large and expensive fixtures, such as a mask stretching frame, through the furnace along with each assembly; in fact, if the tensioning process is carried out as just described, no stretching frames are needed.

Figure 3C:
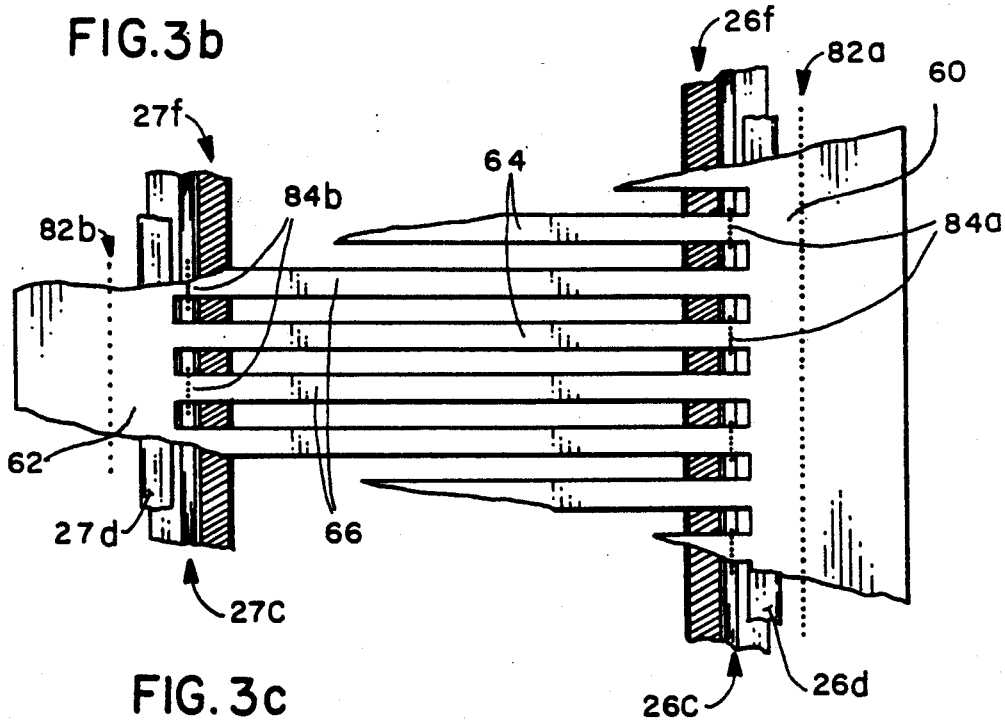
FIG. 3*c* is a plan view depicting additional details of the means and method depicted by FIGS. 3*a* and 3*b*.

Following the devitrification of the solder glass, metal strips 64 belonging to array 60 of mask 28 are severed above the groove 26c as indicated by dotted line segments 84a in FIG. 3c, preferably with the same laser beam used to weld the strips to the metal channels 26d and 27d. Metal strips 66 belonging to array 62 are cut above groove 27c as indicated by dotted line segments 84b in the same figure. The electrical connection between adjacent metal strips is thereby broken, with each array of strips remaining connected to one of the two metal channels 26d or 27d. Cutting of the metal strips in the correct locations is most easily and economically done with a focused laser beam. Preferably, the entire assembly is moved under the incident laser beam, its motion as well as the firing cycle being controlled by a computer.

In lieu of mask cutting by a laser beam, the severing of the mask at dotted line segments 84a and 84b may be accomplished by a fixture having a plurality of knives with angled cutting edges (not shown). The fact that the mask 28 is under tension, and the relatively thinness of the mask foil (about 0.001 inch), makes mechanical cutting feasible. The mask 28 may be trimmed along lines 82a and 82b, also by knife means. Such cutting and trimming means are not the subject of the present invention, but are described and claimed in referent copending application Ser. No. 519,090 of common ownership herewith.

FIGS. 4a and 4b illustrate a modified form of this invention which avoids the use of solder glass during the procedure of attaching the mask to the two support structures. FIG. 4a shows an electrically insulative support structure 86, the body 90 of which is indicated as comprising a ceramic material, secured to a faceplate 87 by beads 88 of solder glass. It is noted that an identical structure (not shown) is located on the opposite side of the faceplate 87 in facing confrontation with structure 86; for purposes of explication, the opposite structure can be considered to have reference numbers identical to those of the support structure 86 depicted in FIG. 4a. FIG. 4b depicts a partial section of a mask 89 secured to support structure 86. The body 90 of support structure 86 is shown as comprising a simple rectangular cross section; its outer portion 92 has a metal channel 94 or cap corresponding to metal channel 26d depicted in FIG. 3a. However, the inner portion 95 of support structure 86 is shown as carrying a second metal channel 96 or cap side-by-side with channel 94. The upper surface 98 of inner portion 95 is shown as having been modified by grinding, milling, electrical discharge machining (EDM) or the like to exhibit periodic depressions 100 having a pitch or repetition period of 2S; i.e., twice the center-to-center spacing of adjacent metal strips of the two mask arrays. The depth of the depression 100 need only be a few thousands of an inch. Their purpose is to avoid contact between channels 96 and the metal strips located directly above the depressions.

During the method of assembly, the mask is stretched across the two support structures and the faceplate raised to the point where the channels make contact with the mask, in the same manner as was previously described in connection with FIGS. 3a and 3b. The pattern of depressions 100 is so arranged that on one side, say the left, all odd-numbered metal strips make contact with the high portions 98, while on the right, all even-numbered strips do so.

The mask is now welded to the outer channels of the two support structures in the same manner as previously described, preferably by laser welding. At this point, the end portions of the mask may be cut off and the assembly removed from the tensioning and welding machine, in analogy with the previously described procedure. However, since in this case the remaining operations also involve welding and cutting, it is advantageous to leave the assembly in place. The metal strips which touch the high portions 98 of the inner channel 96 are welded to these portions, and the undesired electrical connections are severed as described in connection with FIG. 3c. The end portions of the mask may now be cut off.

If, as described, the cutting off of the end portions is postponed and the mask is held under tension until after those metal strips which touch the high portions 98 of the inner channels 96 have been welded thereto, it is no longer necessary to weld all metal strips to outer channels 94. Only those strips which are not welded to the high portions of inner channel 96, i.e., those which pass across depressions 100 of that channel, need to be welded to outer channels 94. This is illustrated in FIG. 4c, which indicates mask 89, shown in partial section, being held under tension by clamps 101. Metal strips 89b contact the high portions 98 of inner channels 96, while strips 89a remain clear of the depressed portions 100. All metal strips make contact with outer channel 94.

Metal strips 89a are welded to metal channel 94 at points indicated by weld symbols (*) 102. Metal strips 89b are welded to the high portions 98 of metal channel 96, as indicated by weld symbols 104. After these welding operations are completed, metal strips 89b are cut at locations 106 as indicated by the dotted lines, excess material of mask 89 is cut off at 108, as indicated by the dotted line, and clamps 101 are released.

Support structure 86 is shown as having a groove 109 in the body 90 of the structure. This groove runs lengthwise in support structure 86 in its area of securement to faceplate 87 for receiving a lengthwise bead of solder glass effective to prestress, upon devitrification of the solder glass, the structure with respect to the faceplate, enabling the assembly to tolerate wide temperatures excursions experienced during production. This concept is the subject of referent copending application Ser. No. 292,197 of common ownership. Although it is not shown, the other ceramic support structures depicted herein may have a similar lengthwise groove.

FIGS. 5a and 5b show a side view and a perspective view, respectively, of another embodiment of the invention. Here, a ceramic mask support structure 110, indicated as mounted on a faceplate 111 and secured by beads 112 of solder glass, is shown as carrying on its top surface 113 a pattern of metallized areas made of a weldable material such as nickel, and having sufficient thickness to permit welding foil mask strips to the metallized areas. (As with the embodiment shown by FIGS. 4a–4c, an identical mask support structure should be considered as being located in facing confrontation on the opposite side of the screen.) The pattern consists of rectangular pads 114 and 116 topping, respectively, outer portion 118 and inner portion 120 of support structure 110. The pads 114 and 116 are noted as having in the direction parallel to the major dimensions of the support structure, a width larger than one-quarter but smaller than three-quarters of the center-to-center spacing of the pads within each row. Pads of the inner portion 120 and outer portion 118 are interleaved as indicated in FIG. 5b. As described previously in connection with the mask according to the invention, each of the arrays of the mask is supported by the outer portion of one support structure and the inner portion of the opposed support structure, in mutual electrically insulating relationship.

Assembly of a mask to a faceplate with this structure proceeds in a manner analogous to the procedure described in connection with FIGS. 3a and 3b. A mask (not shown) is stretched across the support structures 110, the metal strips of the mask are registered with pads 114 and 116 and all strips are welded to the underlying pads while the mask is still under the tension generated by clamps, such as indicated by clamps 76a and 76b of FIGS. 3a and 3b. As indicated by the cutting example of FIG. 4c, the end pieces of the mask are then removed by cutting along the dotted lines 108, and undesired electrical connections are severed by cutting at dotted lines 106; the cutting is adjacent to the pads 116 of the inner portion 120 of the configuration shown by FIGS. 5a and 5b.

The metallized pads 114 and 116 must adhere to the ceramic support structures to a degree sufficient to withstand the pull of the stretched metal strips. Generally, relatively thick layers of easily weldable metals such as nickel do not adhere well enough to ceramics. However, methods to ensure good adherence are known. For example, the ceramic material known as Forsterite may first be coated with a paste made up of a mixture of molybdenum and manganese powders embedded in an organic vehicle. This paste may be applied to the ceramic in the desired pattern by the well-known screen printing process. Screen printing does not achieve the mechanical precision obtainable with more elaborate processes such as photolithography, but it is accurate enough to print pads 114 and 116 in view of the wide tolerance in their widths mentioned above.

The ceramic bars with the printed pads are then fired at 1150 to 1200 degrees C. in a reducing atmosphere, resulting in pads of a molybdenum-manganese alloy which adhere firmly to the ceramic. The desired thickness of nickel is then added by electroplating.

The desired pattern of pads may also be produced by conventional photolithographic processes such as masking, during evaporation and electroplating, those areas where metal is not desired. Alternately, the desired pattern of pads 114 and 116 may be produced by first metallizing the entire top surface 122 and then etching away the areas where metal is not wanted while protecting the areas of pads 114 and 116 from the etchant by appropriate masking.

Rather than the arrangement shown by FIG. 5b in which the pads are shown as being in two rows and linearly offset, the mask mounting means according to the invention may as well comprise a single row of discrete metal pads 115, or electrically conductive terminal areas, equal in number to the strips 117 of the mask, and mounted on a support structure 119 as depicted in FIG. 5c. (As with support structures shown previously, an identical structure should be considered as being located in facing confrontation on the opposite side of the screen.) The mask, in the form of metal strips extending from opposed spines, is positioned across support structure 119 with the strips of the first and second arrays contacting the pads 115, or terminal areas, and in alignment with the stripes of the screen. The mask is then tensed and welded to pads 115 as indicated by the weld symbols. The two arrays of the mask are caused to take the form of mutually insulated, interleaved combs by cutting alternate ones of the ends of the strips adjacent to the spines, as indicated by cut 121 shown as being adjacent to spine 123.

The support structures described, indicated as being composed of an electrical insulator such as a ceramic, may as well be composed of an electrical conductor such as metal. A specially formed metal shadow mask support structure 126 is shown by FIG. 6 as being mounted on a faceplate 128, and secured by beads of solder glass 130. As with the single support structure configurations depicted in FIGS. 4a and 5a, an identical structure should be considered as being located in facing confrontation on the opposite side of faceplate 128. The structures are preferably composed of the previously described Carpenter Alloy 27 because of the compatibility of this alloy with the glass of the faceplate 128. Support structure 126 is indicated as having an outer portion 132 and an inner portion 134, the latter recessed as shown. The resemblance of support structure 126 to the support structures shown by FIGS. 3a and 3b, and the means of attachment of the mask, will be noted, in that the mask 136 is shown as being welded to the outer portion 132 of structure 126, as indicated by the weld symbol. Also, the mask is depicted as being attached to the recessed inner portion 134 of structure 126 by a bead 137 of solder glass, again analogous to the attachment of the mask 28 of FIGS. 3a and 3b.

Support structure 126 is indicated as being filled with two different solder glass compositions 138 and 140, each composition noted as having a different viscosity when in the form of an unfired solder glass paste. This filling ensures that no cavities exist for entrapment of contaminants and the release of gases after the tube is sealed. This inventive concept and method is the subject of referent copending application Ser. No. 178,175 of common ownership herewith.

It will be noted that support structure 126 is indicated as having a slanted side 142. The purpose of the slant is to deflect a laser beam 144, indicated by the dashed line, away from the glass of the faceplate; the beam 144 is used to trim excess material 146 from the mask 136. This inventive concept is the subject of referent copending applications Ser. Nos. 192,412 and 269,822, among others, and of common ownership herewith.

Shadow mask support structures comprised of metal are described and claimed in a series of referent copending applications and patents all of common ownership herewith, including U.S. Pat. Nos. 4,695,761; 4,725,756; 4,686,416; 4,716,334; 4,728,856; 4,783,614; 4,739,217; and applications Ser. Nos. 026,926; 192,412; 234,450; 269,822; and 292,197.

In accordance with the invention, the metal strips of one of the mask arrays may be narrower than the strips of the other array. This inventive concept is depicted in FIG. 7 wherein a partial view of a slit-type shadow mask 148 is shown. A metal strip 150 representing the strips of one mask array is shown as being narrow in relation to two relatively wider metal strips 152 of the other mask array. A predetermined different electrical potential is provided to each of the arrays. The electrical potential which is the more positive may, according to the invention, be applied to the array having the narrower ones 150 of the metal strips, with the result that the potential difference required to make the electron beams passing through slots 154 and overlap on the screen is smaller that which would be required if strips 150 and 152 were of equal width.

The method according to the invention includes, as depicted in FIGS. 2, 3a, 3b and 3c, the providing of two unitary, insulative support structures for supporting the mask, with the outer portions topped with metal caps. Devitrifying solder glass in paste form is applied to the inner portions. Cutting the ends of the strips in staggered fashion, and the trimming of the mask is accomplished with a laser or by mechanical means.

As shown by FIGS. 4a and 4b, the method may comprise topping the inner portions of the support structures with spaced side-by-side metal caps in lieu of solder glass paste, and recessing the caps of the inner portions periodically in correlation with the intercalated periodic array of metal strips to provide clearance for strips secured to the outer portions passing across the inner portions.

The method may include manufacture of the configuration shown by FIGS. 5*a* and 5*b* including attaching discrete pads of metal to the outer portions for receiving and securing respective ones of the mask strips. The method may include linearly offsetting the pads attached to the inner portions from the pads of the outer portions, and cutting by laser (or by mechanical means) in staggered fashion the ends of the strips between the inner and outer portions to cause the first and second arrays of the make to take the form of mutually insulated, interleaved combs. The pads, or terminal areas, may as well comprise a single row, as depicted in FIG. 5*c*. The method may include forming the pads to have a width larger than one-quarter but smaller than three-quarter of the center-to-center spacing of the pads within each row. The pads may be formed by screen printing followed by firing and electroplating, or by other suitable metallizing processes.

The shadow mask according to the inventive method may also be formed to have mask strips of different widths, adapted for receiving an electrical potential which is more positive on the narrower ones of the strips. Also, the center-to-center distance S of the strips may be varied across the width of the mask to compensate for degrouping errors.

While a particular embodiment of the invention has been shown and described, it will be readily apparent to those skilled in the art that changes and modifications may be made in the inventive means and method without departing from the invention in its broader aspects, and therefore, the aim of the appended claims is to cover all such changes and modifications as fall within the true spirit and scope of the invention.

We claim:

1. For use in the manufacture of a post-mask-deflection color cathode ray tube having a faceplate with a centrally located screen composed of colored-light-emitting phosphor stripes, a method comprising:

providing two support structures for supporting a mask and securing said support structures on said faceplate on opposed sides of said screen;

providing a foil shadow mask in the form of metal strips separable into intercalated periodic first and second arrays of electrically conductive strips;

positioning said mask across said support structures with said strips aligned with said stripes of said screen;

securing the ends of the strips of each of said arrays in tension to said support structures; and cutting in staggered fashion the ends of said strips to cause said first and second arrays to take the form of mutually insulated, interleaved combs, whereby predetermined different electrical potentials applied to said arrays will cause electron beams passing through the mask to be deflected by the electrical fields created between said strips.

2. For use in the manufacture of a post-mask-deflection color cathode ray tube having a faceplate with a centrally located screen composed of colored-light-emitting phosphor stripes, a method comprising:

providing two support structures for supporting said mask, each having an outer portion and an inner portion, and securing said support structures on said faceplate on opposed sides of said screen;

providing a foil shadow mask in the form of metal strips separable into intercalated periodic first and second arrays of electrically conductive strips;

positioning said mask across said support structures with the strips of said first and second arrays contacting said inner and outer portions of said support structures, and with said strips aligned with said stripes of said screen;

securing the ends of the strips of each of said arrays in tension to the outer and inner portions of said support structures; and cutting in staggered fashion the ends of said strips between said inner and outer portions to cause said first and second arrays to take the form of mutually insulated, interleaved combs, whereby a predetermined different electrical potential applied to each of said arrays will cause electron beams passing through the mask to be deflected by the electrical fields created between said strips.

3. The method according to claim 2 including performing said cutting with a laser.

4. The method according to claim 2 including forming said support structures of an electrically insulative ceramic.

5. For use in the manufacture of a post-mask-deflection color cathode ray tube having a faceplate with a centrally located screen composed of colored-light-emitting phosphor stripes, a method comprising:

providing two unitary electrically insulative support structures for supporting said mask, each of said support structures having an outer portion and an inner portion separated by a groove, and topping said outer portions with metal caps;

securing said support structures on said faceplate on opposed sides of said screen by devitrifying solder glass;

providing a foil shadow mask in the form of metal strips separable into intercalated periodic first and second arrays of electrically conductive strips;

applying devitrifying solder glass in unfired paste form to said inner portions of said support structures;

positioning said mask across said support structures and aligning said strips with said stripes of said screen, with the strips of said first and second arrays contacting the caps on said outer portions and the solder glass on said inner portions;

tensing said mask and securing the strips in contact with said metal caps by welding, and said strips in contact with said solder glass by devitrifying said solder glass by exposure to a predetermined elevated temperature; and cutting in staggered fashion the ends of said strips between said inner and outer portions of said support structures to cause said first and second arrays to take the form of mutually insulated, interleaved combs, whereby a predetermined different electrical potential applied to each of said the arrays will cause electron beams passing through the mask to be deflected by the electrical fields created between said strips.

6. For use in the manufacture of a post-mask-deflection color cathode ray tube having a faceplate with a centrally located screen composed of colored-light-emitting phosphor stripes, a method comprising:

providing two insulative support structures for supporting said mask, each of said support structures having an outer portion and an inner portion, and topping said portions with spaced metal caps;

securing said support structures on said faceplate on opposed sides of said screen;

providing a foil shadow mask in the form of metal strips separable into intercalated periodic first and second arrays of electrically conductive strips;

positioning said mask across said support structures and aligning said strips with said stripes of said screen, with the strips of said first and second arrays in contact with said metal caps;

tensing said mask and securing said strips to said caps by weldments; and cutting in staggered fashion the ends of said strips between said inner and outer portions of said support structures to cause said first and second arrays to take the form of mutually insulated, interleaved combs, whereby a predetermined different electrical potential applied to each of said arrays will cause electron beams passing through the mask to be deflected by the electrical fields created between said strips.

7. The method according to claim 6 including securing said strips to said caps by laser welding, and cutting the ends of said strips between said inner and outer portions of said support structures by laser.

8. For use in the manufacture of a post-mask-deflection color cathode ray tube having a faceplate with a centrally located screen composed of colored-light-emitting phosphor stripes, a method comprising:

providing two support structures for supporting said mask, each having an outer portion and an inner portion, and topping each portion with spaced, side-by-side metal caps;

securing said support structures on said faceplate on opposed sides of said screen;

providing a foil shadow mask in the form of metal strips separable into intercalated periodic first and second arrays of electrically conductive strips;

recessing said metal caps on said inner portions of said support structures periodically in correlation with said intercalated periodic array of metal strips of said mask to provide clearance for strips secured to said outer portions passing across said inner portions;

positioning said mask across said support structures with the strips of said first and second arrays contacting said inner and outer portions of said support structures, and with said strips aligned with said screen stripes;

securing the mask in tension by welding the strips of each of said arrays to said caps on said inner portions and outer portions of said support structures; and cutting in staggered fashion the ends of said strips between said inner and outer portions to cause said first and second arrays to take the form of mutually insulated, interleaved combs, whereby a predetermined different electrical potential applied to each of said arrays will cause electron beams passing through the mask to be deflected by the electrical fields created between said strips, and whereby electrical interconnection between metal strips is prevented by said recessing of said caps on said inner portions of said support structures.

9. For use in the manufacture of a post-mask-deflection color cathode ray tube having a faceplate with a centrally located screen composed of colored-light-emitting phosphor stripes, a method comprising:

providing two electrically insulative support structures for supporting said mask, each of said support structures having an outer portion and an inner portion;

providing a foil shadow mask in the form of metal strips separable into intercalated periodic first and second arrays of electrically conductive strips;

attaching discrete pads of metal to said outer portions for receiving and securing respective ones of said strips of said first and second arrays;

attaching discrete pads of metal to said inner portions linearly offset from said pads of said outer portions for receiving and securing respective ones of said strips of said first and second arrays;

positioning said mask across said support structures with the strips of said first and second arrays contacting the pads of said inner and outer portions of said support structures, and with said strips aligned with said screen stripes;

securing the mask in tension by welding the strips of each of said arrays to respective pads on said inner portions and outer portions of support structures; and cutting in staggered fashion the ends of said strips between said inner and outer portions to cause said first and second arrays to take the form of mutually insulated, interleaved combs, whereby a predetermined different electrical potential applied to each of said arrays will cause electron beams passing through the mask to be deflected by the electrical fields created between said strips.

10. The method according to claim 9 comprising forming said pads to have a width larger than one-quarter but smaller than three-quarters of the center-to-center spacing of the pads within each row.

11. For use in the manufacture of a post-mask-deflection color cathode ray tube having a faceplate with a centrally located screen composed of colored-light-emitting phosphor stripes, a method comprising:

providing two electrically insulative support structures each having a metal-capped outer portion and metal-capped inner portion for receiving and supporting said mask;

securing said support structures on said faceplate on opposed sides of said screen, providing a foil shadow mask in the form of metal strips separable into intercalated periodic first and second arrays of electrically conductive strips, the strips of one array being narrower than the strips of the other array;

positioning said mask across said support structures with the strips of said first and second arrays contacting the metal caps of said inner and outer portions of said support structures, and with said strips aligned with said screen stripes;

securing the mask in tension by welding the strips of each of said arrays to said caps on said inner and outer portions of said support structures; and cutting in staggered fashion the ends of said strips between said inner and outer portions to cause said first and second arrays to take the form of mutually insulated, interleaved combs.

12. The method according to claim 11 including providing caps in the form of discrete metallized pads to said inner and outer portions of said support structures for receiving and supporting respective ones of said strips.

13. For use in the manufacture of a post-mask-deflection color cathode ray tube having a faceplate with a centrally located screen composed of colored-light-emitting phosphor stripes, a method comprising:

providing two support structures for supporting said mask and attaching said structures to said faceplate on opposite sides of said screen;

providing a foil shadow mask in the form of metal strips separable into intercalated periodic first and second arrays of electrically conductive strips;

attaching mutually insulative terminal areas to said support structures for receiving and securing respective ones of said strips of said first and second arrays;

positioning said mask across said support structures with the strips of said first and second arrays contacting said terminal areas, and with said strips aligned with said screen stripes;

securing the mask in tension by welding the strips of each of said arrays to said terminal areas;

cutting in staggered fashion the ends of said strips to cause said first and second arrays to take the form of mutually insulated, interleaved combs, whereby a predetermined different electrical potential applied to each of said arrays will cause electron beams passing through the mask to be deflected by the electrical fields created between said strips.

14. For use in the manufacture of a post-mask-deflection color cathode ray tube having a faceplate with a centrally located screen composed of colored-light-emitting phosphor stripes, a method comprising:

providing a foil shadow mask in the form of metal strips extending from opposed spines;

providing two ceramic mask support structures for supporting said mask and attaching to said structures discrete pads of metal equal in number to said strips of said mask;

locating said support structures on opposite sides of said screen and attaching said structures to said faceplate;

positioning said mask across said support structures with the strips of said first and second arrays contacting said pads, and in alignment with said stripes of said screen;

tensing the mask and welding said strips to said pads;

cutting alternate ones of the ends of said strips adjacent to said spines to cause said first and second arrays to take the form of mutually insulated, interleaved combs, whereby predetermined different electrical potentials applied to said spines will cause electron beams passing through the mask to be deflected by the electrical fields created between said strips.

15. For use in the manufacture of a post-mask-deflection color cathode ray tube having a faceplate with a centrally located screen composed of colored-light-emitting phosphor stripes, a method comprising:

providing two metal support structures for supporting said mask, each of said support structures having an outer portion and an inner recessed portion, separating said outer and inner portions by a groove, and topping said outer portions with metal caps;

securing said support structures on said faceplate on opposed sides of said screen by devitrifying solder glass;

providing a foil shadow mask in the form of metal strips separable into intercalated periodic first and second arrays of electrically conductive strips;

applying devitrifying solder glass in unfired paste form to said recessed inner portions of said support structures;

positioning said mask across said support structures and aligning said strips with said stripes of said screen, with the strips of said first and second arrays contacting the caps on said outer portions and the solder glass on said inner portions;

tensing said mask and securing the strips in contact with said metal caps by welding, and securing said strips in contact with said solder glass by devitrifying said solder glass by exposure to a predetermined elevated temperature; and cutting in staggered fashion the ends of said strips between said inner and outer portions of said support structures to cause said first and second arrays to take the form of mutually insulated, interleaved combs, whereby a predetermined different electrical potential applied to each of said the arrays will cause electron beams passing through the mask to be deflected by the electrical fields created between said strips.

* * * * *